US007143672B1

(12) United States Patent
Di Bitonto et al.

(10) Patent No.: US 7,143,672 B1
(45) Date of Patent: Dec. 5, 2006

(54) HAND TOOLS WITH SUPPRESSIBLE STAY-OPEN MECHANISM

(75) Inventors: Anthony Di Bitonto, Brooklyn, NY (US); John Thomas Jacobsen, New Bedford, MA (US); Wilfrido Loor, Brooklyn, NY (US)

(73) Assignee: Helen of Troy Limited, Bridgetown (BB)

( * ) Notice: Subject to any disclaimer, the term of this patent is extended or adjusted under 35 U.S.C. 154(b) by 0 days.

(21) Appl. No.: 11/191,535

(22) Filed: Jul. 28, 2005

(51) Int. Cl.
*B25B 7/02* (2006.01)

(52) U.S. Cl. ..... 81/417; 81/427

(58) Field of Classification Search ..... 81/417, 81/427, 427.5
See application file for complete search history.

(56) References Cited

U.S. PATENT DOCUMENTS

| | | | | |
|---|---|---|---|---|
| 2,827,815 | A * | 3/1958 | Smoyak | 81/417 |
| 4,304,158 | A | 12/1981 | Brunosson | |
| 4,400,876 | A | 8/1983 | Brown | |
| 4,739,552 | A | 4/1988 | Thomas | |
| 5,522,289 | A | 6/1996 | Eggert | |
| 5,619,892 | A | 4/1997 | Eggert | |
| 6,109,143 | A | 8/2000 | Jansson | |
| 6,263,770 | B1 | 7/2001 | Gomas et al. | |
| 7,021,177 | B1 * | 4/2006 | Lovemark et al. | 81/417 |
| 2004/0163495 | A1 | 8/2004 | Konen | |

* cited by examiner

*Primary Examiner*—David B. Thomas
(74) *Attorney, Agent, or Firm*—Greer, Burns & Crain, Ltd

(57) ABSTRACT

A hand tool has two crossed members each having a handle and a jaw connected to each other at a pivot point. A leaf spring biases the handles towards an open position. The leaf spring can be selectively engaged or disengaged by the user.

3 Claims, 2 Drawing Sheets

HAND TOOLS WITH SUPPRESSIBLE STAY-OPEN MECHANISM

This invention relates to hand tools that grip, such as pliers and wire cutters, having a spring that urges opposing handles apart to open opposing jaws, and more particularly, to such hand tools in which the spring can be selectively disabled.

BACKGROUND OF THE INVENTION

Gripping hand tools such as pliers and wire cutters (collectively called pliers herein) with springs or other resilient means that urge the handles apart are well-known. Such pliers are particularly well suited for repetitive applications. Typically, pliers have two crossed members each having a jaw, a handle and a pivot point between the jaw and handle. The crossed members are connected by a pivot pin at the members' respective pivot points. A spring is then positioned between the two handles to urge the handles open. When the handles are compressed, the spring is compressed. When the handles are released, the spring expands, forcing the handles apart. Examples of such pliers include U.S. Pat. No. 4,739,552 to Thomas, U.S. Pat. No. 5,522,289 to Eggert and U.S. Pat. No. 6,109,143 to Jansson.

A user may wish for the handles of such normally-open pliers (i.e., handles open and jaws open) to stay closed when the handles are released at certain times, such as when the pliers are not in use and are being stored. Thus, there is a need for normally-open pliers in which the mechanism that forces the handles apart can be disengaged or disabled so that the pliers can be used without being normally open.

SUMMARY OF THE INVENTION

In keeping with one aspect of the invention, hand tools include a first member having a first jaw, a first handle and a first pivot point between the jaw and the handle. A second member has a second jaw, a second handle, and a second pivot point between its jaw and handle. The first member is connected to the second member by a pivot pin at the respective pivot points of the first and second members.

One end of a leaf spring or other suitable spring is attached to the first handle, facing the second handle. The other end of the spring is in free contact with the second handle. The spring is enabled when it is in contact with the second member, and pushes the handles apart when they are released by the user to a normally-open position. The jaws are normally kept open by the spring.

The spring may be suppressed, by compression or some other way, to prevent the free end of the spring from contacting the second handle to urge the handles apart. When the user does not want the handles to open upon release, the user suppresses or disables the spring by pushing a slide along rails on the first member. The slide pulls the spring away from the second member, which disables the spring. When the user wishes to utilize the hand tool in the normally-open mode, the user disengages the slide, thus allowing the other end of the spring to engage the second handle and urge the handles apart.

BRIEF DESCRIPTION OF THE DRAWINGS

The above mentioned and other features of this invention and the manner of obtaining them will become more apparent and the invention itself would be best understood by reference the following description of an embodiment of the invention taken in conjunction with the accompanying drawings in which.

DETAILED DESCRIPTION

Figure 2:
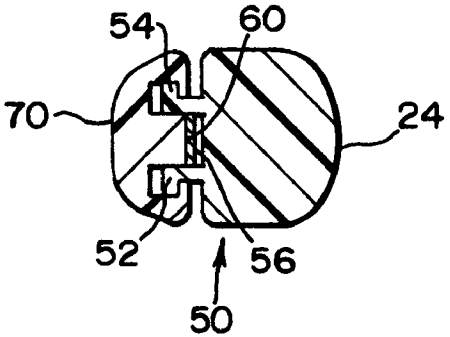
FIG. 2 is a cross-sectional view of the pliers of FIG. 1, taken along lines 2—2 of FIG. 1.
Figure 1:
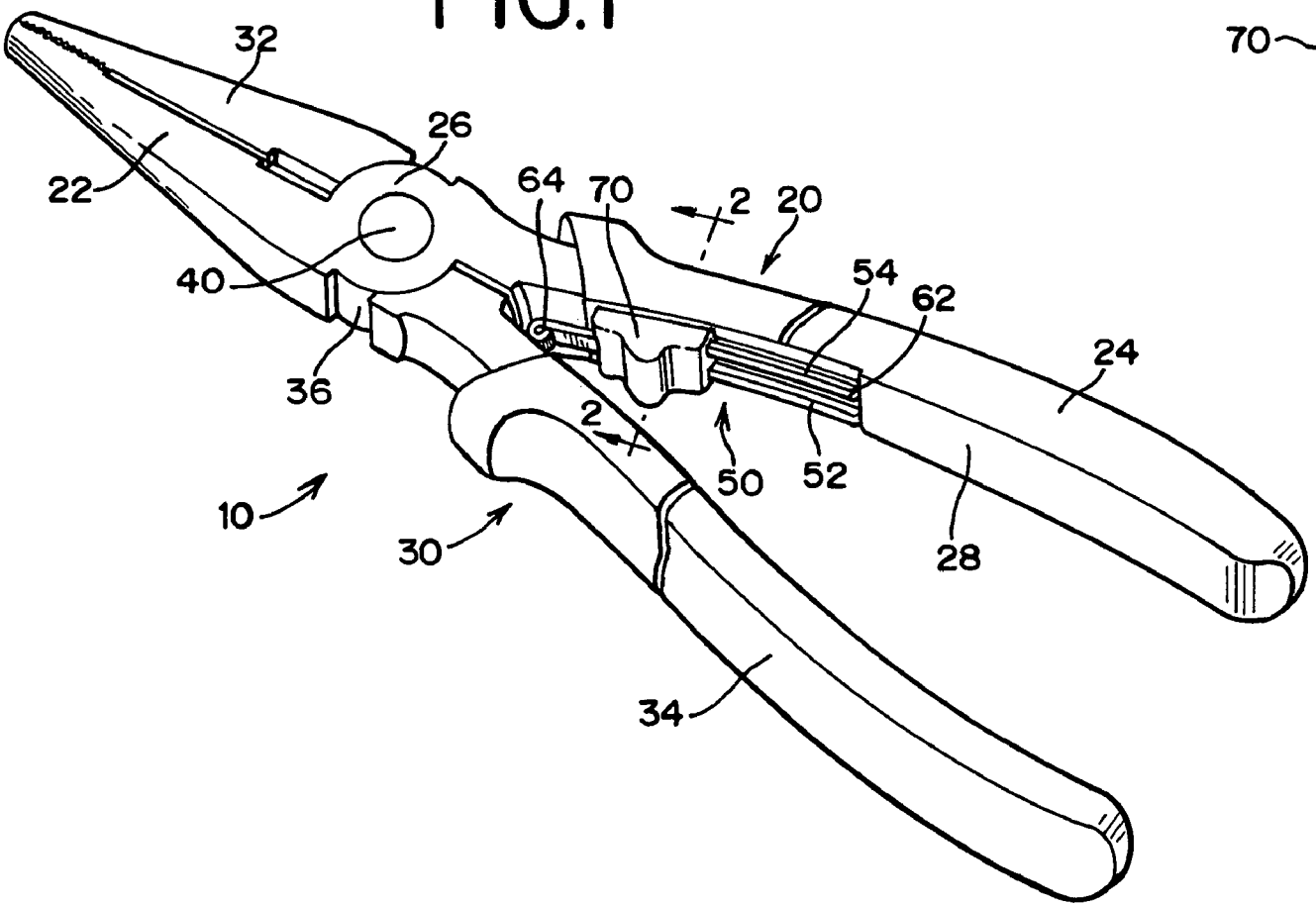
FIG. 1 is a perspective view of one embodiment of a hand tool made in accordance with the present invention, shown with the spring disabled.
Figure 3:
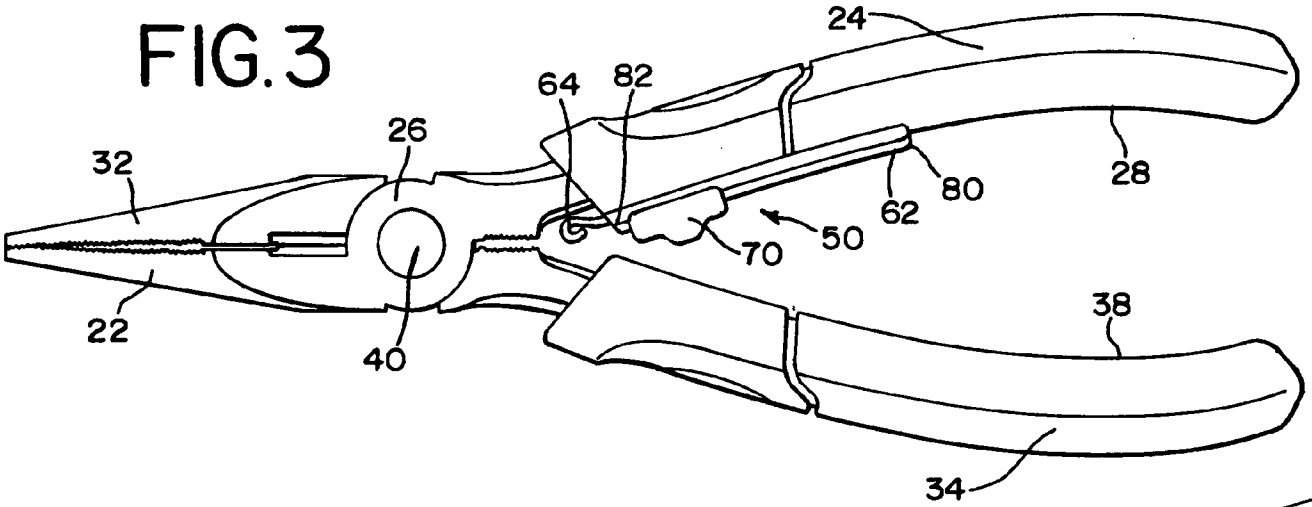
FIG. 3 is a side view of the pliers of FIG. 1.

Referring to FIGS. 1–4, a hand tool 10 such as pliers, wire cutters or the like ("pliers") includes a first member 20, a second member 30 and a hinge pin 40 which connects the first and second members for pivotal movement with respect to each other. The first member 20 has a first jaw 22, a first handle 24 and a first pivot point 26 between the first jaw and the first handle. The second member 30 has a second jaw 32 and a second handle 34, with a second pivot point 36 between the second jaw and second handle.

Any suitable pin connection can be used to connect first member 20 and second member 30 at pivot points 26 and 36. Customarily such pivotal connection is flush with the respective first and second members. Once assembled, first interior side 28 on first handle 24 and second interior side 38 on second handle 34 face each other.

A suppressible stay-open spring mechanism 50 is located on the first handle 24. The mechanism 50 includes raised parallel tracks 52 and 54 on the first interior side 28. A spring 60 is interposed between tracks 52 and 54. Preferably the spring is a leaf spring that runs between and parallel to tracks 52 and 54.

Figure 4:
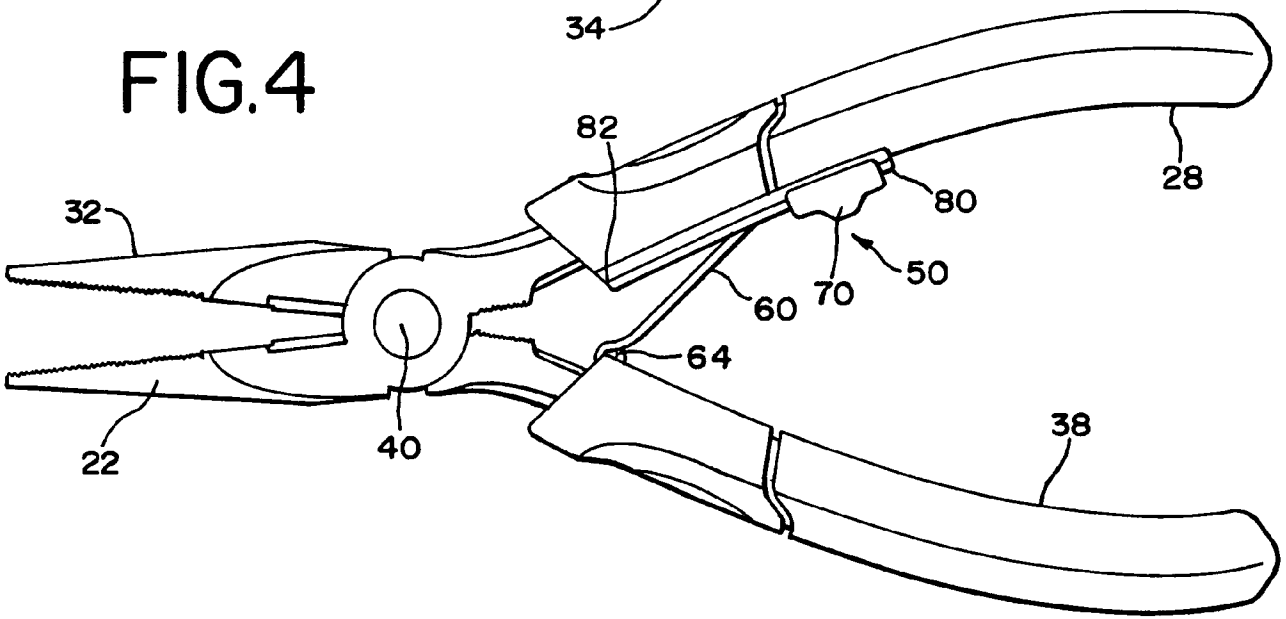
FIG. 4 is a side view of the hand tool of FIG. 1, shown with the spring enabled and the handles forced apart.

The spring 60 is secured to the first interior side 28 at one end 62 in any suitable manner, such as welding, molding into a handle cover, fastening and the like. Spring free end 64 projects away from handle 24 towards second interior side 38. As seen in FIG. 4, spring free end 64 touches second interior side 38 when the spring is not blocked, biasing the handles 20 and 30 to an open position.

A button 70 rides on tracks 52 and 54 from track beginning 80 to track end 82. As the button moves towards track end 82, as in FIG. 3, it depresses at least part of the spring in the channel or cavity 56 between tracks 52 and 54, preventing free spring end 64 from contacting the second interior side 38. This disables the spring, enabling the user to open the handles manually.

The advantages of this invention are now apparent. The user can alternately use the spring to urge the handles open or, if the user so desires, the user can disable this feature and use the hand tool without the effects of the spring.

While the principles of the invention have been described above in connection with specific apparatus and applications, it is to be understood that this description is made only by way of example and not as a limitation on the scope of the invention.

What is claimed is:

1. A hand tool comprising a first member having a first jaw, a first handle, and a first pivot point between the first jaw and the first handle;

a second member having a second jaw, a second handle, and a second pivot point between the second jaw and the second handle;

said first and second members being pivotably connected by a pivot pin at the first and second pivot points;

a leaf spring connected to said first handle and capable of urging said second handle away from said first handle;

a slide movably attached to the first handle and capable of moving along the first handle between the end of the first handle and the pivot point;

said slide pressing the spring into the first handle when said slide is moved towards the pivot point along the first handle, preventing said spring from touching said second handle.

2. The hand tool of claim 1 wherein at least part of said leaf spring is set in a channel on said first handle, the slide moves along the channel, and at least part of the leaf spring fits in the channel.

3. The hand tool of claim 2 wherein said channel is formed by two parallel rails on opposite sides of said channel, at least part of said leaf spring being located between said rails, and the slide being slidably secured to said rails for movement between a first position where the free end of said leaf spring is urged against said second member, and a second position where the free end of said leaf spring does not touch said second member.

* * * * *